US005826296A

United States Patent [19]

Steven

[11] Patent Number: 5,826,296

[45] Date of Patent: Oct. 27, 1998

[54] ROLL CLEANING ASSEMBLY

[75] Inventor: Andrew Steven, Greenside, England

[73] Assignee: Crabtree of Gateshead Limited, England

[21] Appl. No.: 724,842

[22] Filed: Oct. 3, 1996

[30] Foreign Application Priority Data

Oct. 7, 1995 [GB] United Kingdom ..... 9520536

[51] Int. Cl.[6] ..... D01H 11/00

[52] U.S. Cl. ..... 15/256.51; 100/174; 399/350; 399/351; 399/358; 101/425; 118/261; 118/104; 118/203; 118/204

[58] Field of Search ..... 15/256.51, 256.53, 15/256.5; 100/174; 399/350, 351, 358; 101/425; 118/119, 126, 122, 261, 104, 203, 204; 198/497, 498, 499

[56] References Cited

U.S. PATENT DOCUMENTS

| | | | |
|---|---|---|---|
| 3,113,890 | 12/1963 | Johnson et al. | 15/256.51 |
| 3,802,339 | 4/1974 | Andersson et al. | 15/256.51 |
| 4,174,172 | 11/1979 | Lane | 399/350 |
| 4,281,434 | 8/1981 | Sullivan | 15/256.53 |
| 5,454,870 | 10/1995 | Sieberth | 15/256.51 |

*Primary Examiner*—Gary K. Graham
*Attorney, Agent, or Firm*—Rodman & Rodman

[57] ABSTRACT

In a roll cleaning assembly devised to remove liquid material continuously from the cylindrical surface of a rotating roll, for example from a compression roll (3) in a coating machine, a blade holder (5) which releasably retains a doctor blade (7) is mounted on a rigid support member (4), and force is applied along the length of the doctor blade, to urge it into contact with the roll, by force means (13) mounted independently of the blade support member.

14 Claims, 1 Drawing Sheet

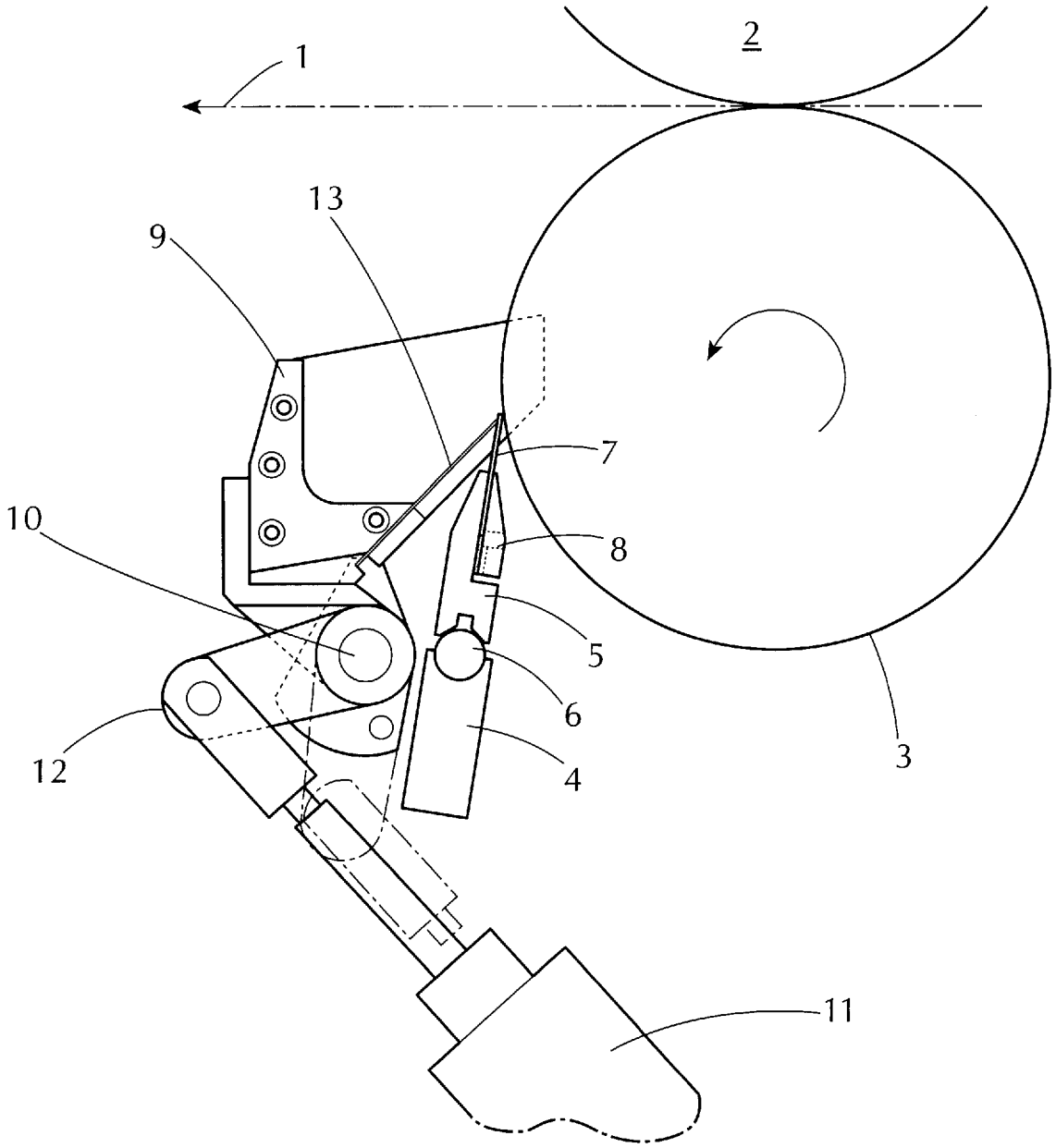
1
2
13
9
7
10
8
5
6
12
4
3
11

ROLL CLEANING ASSEMBLY

BACKGROUND OF THE INVENTION

The present invention is a roll cleaning assembly, devised to remove liquid material continuously from the surface of a rotating roll. It has been devised for use in the industrial application of decorative surfaces to metal in sheet form but is suitable for use in other fields, for example in the paper milling and food processing industries.

In the production of decorated metal sheets, a continuous film of pigmented base coat or lacquer may be applied to the sheets, respectively before or after the printing process. The coating or lacquer is applied to the sheets by an application roll as the sheets pass in a nip between that roll and a compression roll, which latter is usually of cast iron or other metal. It is required that the coating be applied to only one face of the metal sheet and that contamination of the other face of the sheet should be avoided. However, particularly between sheets, the coating material may become transferred to the compression roll and from there to the back of the next metal sheet. It is therefore essential to remove any such material from the compression roll before the roll contacts the sheet. To this end, a doctor blade is usually applied continuously to the compression roll during the rotation of the roll.

The edge of the doctor blade contacts the compresssion roll. Good continuing performance of the doctor blade in successfully removing the base coat or lacquer from the surface of the roll depends upon a close matching of the profiles of the two mating surfaces on a microscopic scale. When a blade is first installed, an initial bedding-in period is required to achieve that match. Subsequent wear of the blade edge in operation limits the useful life of the blade. Thus a new blade may require a bedding-in period of, say, 10 to 30 minutes and may thereafter have a useful life of only a few hours.

SUMMARY OF THE INVENTION

Against this background, it is an object of the present invention to provide a roll cleaning assembly by means of which the bedding-in period of such a doctor blade may be reduced and/or the effective operational life of the blade may be increased.

The assembly according to the present invention, for removing liquid material continuously from the cylindrical surface of a rotating roll, comprises a rigid blade support member extending parallel to the axis of the roll, a blade holder mounted upon said member and adapted releasably to retain a doctor blade along an axis parallel to said roll axis, and force means, mounted independently of said blade support member along a further axis parallel to said roll axis and directed to apply force along the length of the doctor blade to urge said blade into contact with the surface of the roll.

It is an important feature of the present invention that the supporting of the doctor blade and the application of force to the blade are two independent functions. In one prior form of roll cleaning assembly, the blade is supported upon a trough designed to receive liquid removed from the roll and the load upon the blade is applied via the trough. In that assembly, distortion of the profile of the trough under pressure leads to the uneven application of force to the doctor blade, leading to uneven wear of the blade in use and a resultant shortening of its useful life.

In the roll cleaning assembly according to the present invention, the blade support member may be a part of the structural framework of the coating machine or may be a beam or plate, preferably extending between the end-plates of the machine, provided specifically for the purpose of supporting the doctor blade holder. The doctor blade holder may be fixedly mounted upon the blade support member, in which case the pressing of the blade into contact with the surface of the roll relies upon limited flexibility of the blade along its length. However, in an alternative, preferred form, the doctor blade holder is pivotally mounted upon the blade support member, for pivotal movement about an axis parallel to the axis of the roll, and the blade is thus able to move towards and away from the roll by pivoting.

The force means by which force is applied along the length of the doctor blade to urge it into contact with the roll is, as already stated, independent of the blade-supporting function. In one preferred form of the invention, the force means takes the form of one or more springs, for example an array of compression or leaf springs, or more preferably a flexible strip of spring steel. The pressure is preferably applied close to the edge of the blade which contacts the roll, most preferably along the whole of the length of that edge. The assembly will usually include a trough into which material removed from the roll may flow. In a preferred form of the invention, the force means is mounted upon such a trough and the trough in turn is mounted for linear or non-linear, preferably pivotal, movement towards the doctor blade.

When the force means is mounted upon a trough or similar structure in this way, the trough or other structure may in turn be urged towards the doctor blade by any of various methods, including pneumatic, hydraulic, electromechanical and mechanical methods. For example, the trough may be actuated by one or more pneumatic cylinders operating upon the trough. By varying the air pressure in such a pneumatic cylinder or cylinders, it is possible to vary the load upon the doctor blade and adapt it to take account of any variation in the operating requirements of the blade.

Instead of the doctor blade being loaded by one or more springs as described above, the force means may comprise a pneumatic, hydraulic, mechanical or electromechanical means, acting directly upon the doctor blade. For example, the force means may comprise an array of air cylinders or oil cylinders, acting upon the length of a linear structure bearing upon the tip of the doctor blade and urging it into contact with the roll.

The doctor blade is retained releasably by the blade holder. Preferably the blade is retained by means of a clamping bar extending throughout the length of the blade and blade holder and held against the body of the blade holder by a plurality of retaining bolts or some form of quick-release mechanism.

BRIEF DESCRIPTION OF THE DRAWINGS

The invention will now be further described, by way of example only, with reference to the accompanying DRAWING, which is an elevation from one end of one preferred embodiment of the roll cleaner assembly according to the present invention.

DESCRIPTION OF THE PREFERRED EMBODIMENT

In the illustrated assembly, metal sheet is fed, in the direction of the arrow 1, through the nip between a coating roll 2 and a cast iron compression roll 3. The rolls are mounted within the frame (not shown) of a coating machine, between the end-plates of which a stiff beam 4 extends.

Upon the upper edge of the beam 4, a blade holder 5 is mounted for pivotal movement about a pivot 6. The doctor blade 7 is retained upon the blade holder 5 by clamping between a clamp bar 8 and the body of the blade holder.

Independently of the beam 4, a trough 9, for collecting material removed from the compression roll 3 by the doctor blade 7, is pivoted between the machine end-plates upon a pivot 10. Rotation of the trough 9 about the pivot 10 is effected by means of two pneumatically-interlinked air cylinders 11, mounted at the ends of the trough and working via linkages 12. A spring 13 formed of flexible spring steel strip is cantilevered from the trough 9 and bears upon the doctor blade 7 along a line close to the sharp edge of the blade.

The beam 4, blade holder 5, clamp bar 8, doctor blade 7, trough 9 and spring 13 all extend across the full width of the machine, from one end of the compression roll 3 to the opposite end. Thus, by application of pneumatic pressure from the air cylinders 11, a load is applied, via the spring 13, along the full length of the doctor blade.

In experimental use of the illustrated assembly, it has been possible to achieve both a shorter bedding-in time and a longer operating life for the doctor blade 7 than was possible using a prior assembly of this general type.

I claim:

1. A roll cleaning assembly, for removing liquid material continuously from the cylindrical surface of a rotating roll, comprising a rigid blade support member extending parallel to the axis of the roll, a blade holder mounted upon said member and adapted releasably to retain a doctor blade along an axis parallel to said roll axis, and force means, mounted independently of said blade support member along a further axis parallel to said roll axis and directed to apply force along the length of the doctor blade to urge said blade into contact with the surface of the roll.

2. A roll cleaning assembly according to claim 1, wherein the blade support member is a part of the structural framework of a machine comprising the rotating roll.

3. A roll cleaning assembly according to claim 1, wherein the blade support member is a beam or plate.

4. A roll cleaning assembly according to claim 3, wherein the blade support member extends between the end-plates of the machine comprising the rotating roll.

5. A roll cleaning assembly according to claim 1, wherein the blade holder is fixedly mounted upon the blade support member,

6. A roll cleaning assembly, for removing liquid material continuously from the cylindrical surface of a rotating roll, comprising a rigid blade support member extending parallel to the axis of the roll, a blade holder pivotally mounted upon said member for pivotal movement about an axis parallel to the axis of the roll and adapted releasably to retain a doctor blade along an axis parallel to said roll axis, and force means, mounted independently of said blade support member along a further axis parallel to said roll axis and directed to apply force along the length of the doctor blade to urge said blade into contact with the surface of the roll.

7. A roll cleaning assembly according to claim 6, wherein the force means comprises one or more springs.

8. A roll cleaning assembly according to claim 7, wherein the force means comprises a flexible strip of spring steel.

9. A roll cleaning assembly according to claim 6, wherein the force means applies force close to the edge of the blade which contacts the roll, along the whole of the length of that edge.

10. A roll cleaning assembly comprising a rigid blade support member extending parallel to the axis of the roll, a blade holder mounted upon said member and adapted releasably to retain a doctor blade along an axis parallel to said roll axis, a trough into which material removed from the roll may flow, said trough being mounted for pivotal movement towards the doctor blade, and force means mounted upon said trough and directed to apply force along the length of the doctor blade to urge the blade into contact with the roll.

11. A roll cleaning assembly according to claim 10, wherein the trough is urged towards the doctor blade by one or more pneumatic cylinders.

12. A roll cleaning assembly according to claim 10, wherein the blade holder retains the blade by means of a clamping bar extending throughout the length of the blade and blade holder.

13. A roll cleaning assembly as claimed in claim 12, wherein the clamping bar is held against the body of the blade holder by a plurality of retaining bolts.

14. A roll cleaning assembly as claimed in claim 12, wherein the clamping bar is held against the body of the blade holder by a quick-release mechanism.

* * * * *